US005169228A

United States Patent [19]

Breitzler

[11] Patent Number: 5,169,228

[45] Date of Patent: Dec. 8, 1992

[54] COLD LIGHT MIRROR LAMP

[75] Inventor: Hans-Jürgen Breitzler, Lohnweiler, Fed. Rep. of Germany

[73] Assignee: Leuchtenfabrik, Lauterecken, Fed. Rep. of Germany

[21] Appl. No.: 867,757

[22] Filed: Apr. 13, 1992

Related U.S. Application Data

[63] Continuation-in-part of Ser. No. 719,741, Jun. 24, 1991, abandoned.

[30] Foreign Application Priority Data

Jul. 3, 1990 [DE] Fed. Rep. of Germany ..... 4021210

[51] Int. Cl.[5] ..... F21V 17/00

[52] U.S. Cl. ..... 362/293; 362/307; 362/310

[58] Field of Search ..... 362/202, 208, 307, 310, 362/327, 329, 293, 294, 345, 226

[56] References Cited

U.S. PATENT DOCUMENTS

| | | | |
|---|---|---|---|
| 2,592,208 | 4/1952 | Stamper | 362/208 |
| 3,639,750 | 2/1972 | Anthonijsz | 362/226 |
| 3,766,377 | 10/1973 | Junginger | 362/232 |
| 3,944,320 | 3/1976 | Melintic | 362/293 |
| 4,216,464 | 8/1980 | Terry | 362/103 |
| 4,774,644 | 9/1988 | Ohashi | 362/208 |
| 5,055,988 | 10/1991 | Cartwright | 362/804 |

*Primary Examiner*—Richard R. Cole
*Attorney, Agent, or Firm*—McGlew & Tuttle

[57] ABSTRACT

A cold light mirror lamp which comprises of a mirror reflector (1), a low-voltage lamp (2) arranged in mirror reflector, and a cover glass (3) closing the light passage opening (9) of the mirror reflector (1). The cover glass (3) is detachably connected to the mirror reflector (1) via a bayonet connection (14) or a screw connection.

9 Claims, 1 Drawing Sheet

COLD LIGHT MIRROR LAMP

This is a continuation-in-part application of application Ser. No. 07/719,741 filed Jun. 24, 1991, now abandoned.

FIELD OF THE INVENTION

The present invention pertains to a cold light mirror lamp including a mirror reflector, a low voltage lamp and a cover glass forming an assembly with the mirror reflector.

BACKGROUND OF THE INVENTION

In commercially available cold light mirror lamps the light passage opening of the mirror reflector is closed by a cover glass which is rigidly and nondetachably connected to the mirror reflector. The cover glass forms a protective means for the lamp and the inside of the mirror reflector, on the one hand, and, on the other hand, an accident prevention means is provided by preventing the lamp, which is particularly hot when turned on, from being touched. Due to the nondetachable connection between the mirror reflector and the cover glass, the entire assembly unit consisting of the mirror reflector, lamp, and cover glass must be replaced in the case of damage to the mirror reflector or cover glass.

In another, commercially available cold light mirror lamp, which is also provided with a cover glass, the cover glass is detachably arranged on the beaded edge of the mirror reflector by means of a holding ring made of sheet metal. This is done either by bending a plurality of flaps formed by cuts in the holding ring over the beaded edge, or by connecting the holding ring to a lamp holder by means of two spring clips passed through corresponding holes in the holding ring. The advantage of the detachable connection between the mirror reflector and the cover glass is opposed by the disadvantage of the increased technical expense, especially in the case of the second version with the spring clips.

SUMMARY AND OBJECTS OF THE INVENTION

It is an object of the present invention to provide a cold light mirror lamp or metal oxide vaporized mirror lamp (wherein the heat at the light outlet of the mirror is reduced by 80%), provided with a cover glass (made of mineral glass), in which the cover glass can be mounted on and again removed from the mirror reflector (also made with a mineral glass substrate) in a simple manner.

According to the invention, a cold light mirror lamp is provided including a mirror reflector (with metal oxide vapor deposited on a mineral glass substrate), a low-voltage lamp arranged in the reflector and supported thereby and a cover glass element (formed of mineral glass) closing a light passage opening of the mirror reflector. The cover glass is provided detachably connected to the mirror reflector via direct force locking connection means.

By detachably connecting the cover glass to the mirror reflector by a direct, force-locking connection, the cover glass can be mounted on and, if desired, removed from, the mirror reflector without additional auxiliary or holding means, so that a lamp arranged detachably in the mirror reflector can be replaced in the case of a defect, or even the mirror reflector or the cover glass can be replaced individually in the case of damage.

The direct force-locking connection is designed as a bayonet connection or as a screw connection, wherein a first part of the connection elements is provided on the cover glass (formed of mineral glass as an integral part of the cover glass element), and the other part of the connection elements, which corresponds to the first part, is provided on the mirror reflector (formed of mineral glass as an integral part of the mirror reflector).

The bayonet connection preferably includes a mineral glass beaded edge provided formed on an outer rim of the mirror reflector wherein the beaded edge has at least two recesses. The beaded edge delimits the light passage opening. The cover glass includes at least two essentially L-shaped projections (preferably formed of mineral glass) whose free ends can be passed through the recesses in the beaded edge and extend behind these recesses after a rotation relative to the mirror reflector. For the screw connection arrangement, the mirror reflector is provided with outwardly directed thread elements (preferably formed of mineral glass) on a bead edge delimiting the light passage opening. The cover glass is provided with complimentary inwardly directed thread elements on an axially extending ring (also preferably formed of mineral glass).

Any desired number of cover glasses with different optical and/or color properties, which are interchangeable with one another, are associated with the mirror reflector in order to change the angle of radiation and/or the color character of the lamp.

A further object of the invention is to provide a cold light mirror type lamp having primary components which are separable from each other and which construction is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
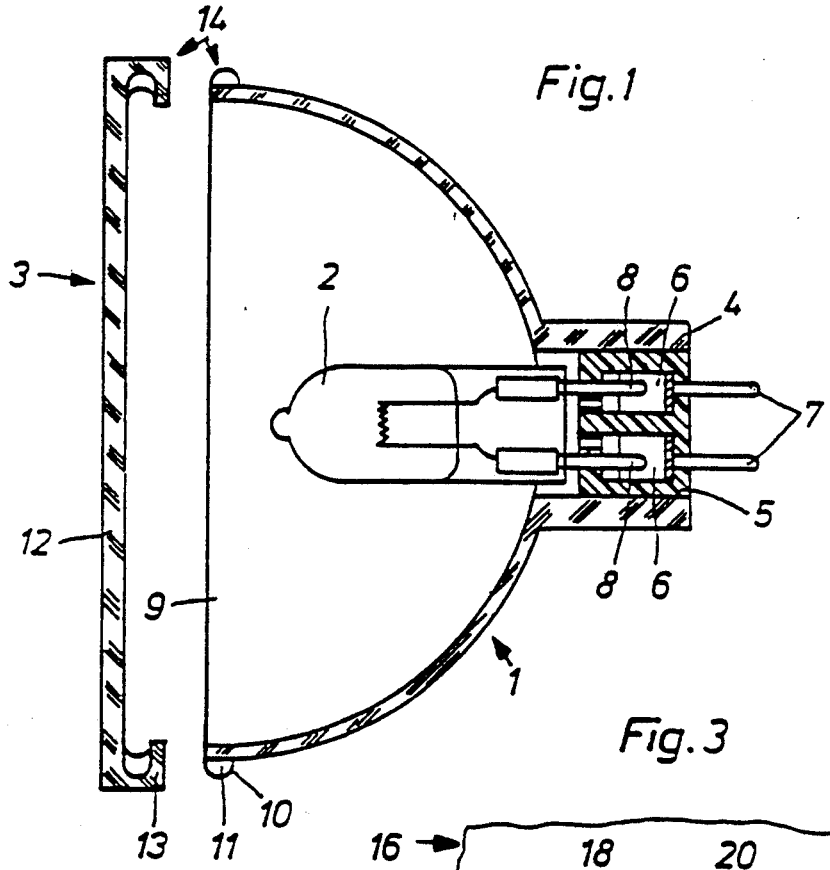
FIG. 1 is a sectional representation of a cold light mirror lamp or metal oxide vaporized mirror lamp and a mineral glass cover glass, which can be connected to the mirror reflector (also of mineral glass) via a bayonet connection according to the invention.

Referring to the drawings, in particular, the cold light mirror lamp or metal oxide vaporized mirror lamp according to a first embodiment of the invention comprises a mirror reflector 1, a low-voltage lamp 2, and a cover glass 3.

According to the invention, the mirror reflector is provided formed of a mineral glass substrate (as shown in FIG. 1) with preferably a metal oxide coating which is vapor deposited to provide a metal oxide vaporized mirror element or mirror reflector 1 to reflect cold light and allow infrared radiation to pass therethrough. The cover glass 3 is advantageously formed of mineral glass according to the invention (as shown in FIG. 1).

An insert 5 made of an electrically nonconducting material is cemented into a projection 4 of the mirror reflector 1. Two spring clamps 6, each of which has a connection pin 7 projecting from the insert 5, are arranged in the insert 5. The mirror reflector 1 can be connected to a lamp holder (not shown) by means of the connection pins 7.

To mount the lamp 2, its connection pins 8 are pushed into the spring terminals 6 through passage holes (not specifically designated) of the insert 5. Thus, the lamp 2 is detachably connected to the mirror reflector 1 and can be replaced if necessary.

Figure 2:
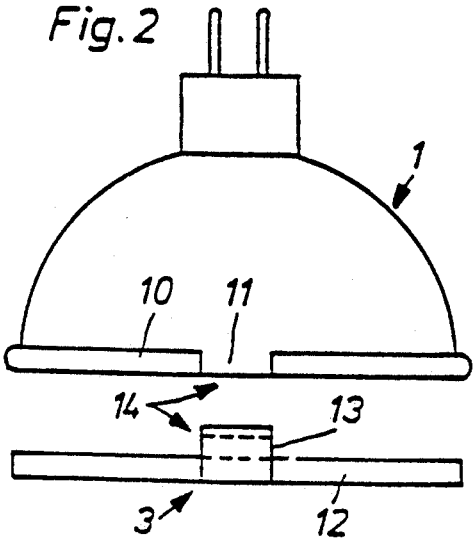
FIG. 2 is a front view of the cold light mirror lamp and the cover glass from FIG. 1.

The light passage opening 9 of the mirror reflector 1 is delimited by a beaded edge (preferably formed of mineral glass) 10. The beaded edge 10 contains two recesses 11, one of which is shown in FIG. 2.

The cover glass 3 consists of a glass plate 12 (e.g., mineral glass) and two essentially L-shaped projections (preferably formed of mineral glass 13, whose arrangement and width are adapted to the recesses 11.

To mount the cover glass 3, the projections 13 are passed through the recesses 11 (preferably formed of mineral glass), after which the cover glass 3 is rotated by at least so much that the projections 13 will fully grip behind the beaded edge 10. The shape and the depth of the projections 13 are adjusted to the shape and thickness of the beaded edge 10 such that the cover glass 3 can be rotated only by overcoming a frictional resistance, so that the cover glass 3 will sit tightly on the mirror reflector 1 in a self-locking manner.

The beaded edge 10 provided with the recesses 11 forms a bayonet connection 11 with the projections 13.

Figure 3:
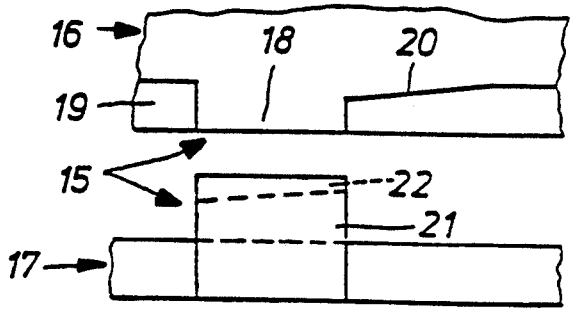
FIG. 3 is an enlarged scale view of connection elements of an alternative bayonet connection according to the invention.

In the alternative embodiment of a bayonet connection 15 between a mirror reflector 16 and a cover glass 17, which is shown in FIG. 3, a section 20 of the beaded edge (preferably formed of mineral glass) 19 located next to each recess 18 in the beaded edge 19 has a wedge-shaped design. The L-shaped projections 21 of the cover glass 17 are designed correspondingly by designing a rib (preferably formed of mineral glass) 22 extending behind the beaded edge 19 or its sections 20 in the form of a wedge.

In the case of the bayonet connection 15, the cover glass 17 can be clamped on the mirror reflector 16 by appropriate rotation due to the wedge-shaped design of the elements 20 and 22, as a result of which reliable connection between the cover glass 17 and the mirror reflector 16 is guaranteed even in the case of greater dimensional tolerances in terms of the thickness of the beaded edge 19 and the depth of the projections 21.

Figure 4:
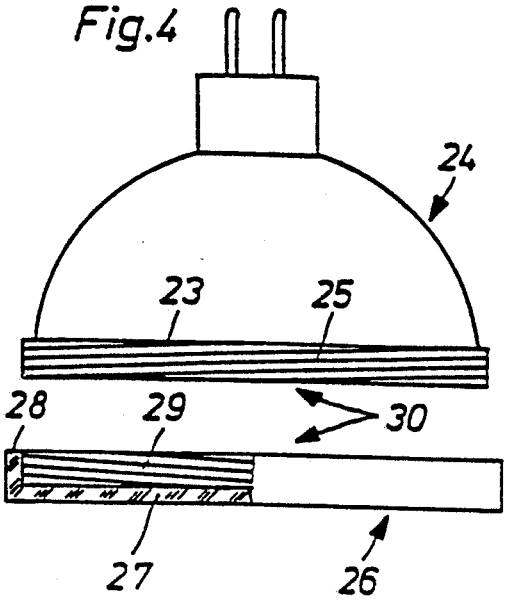
FIG. 4 is a partially sectional view showing a cold light mirror lamp and cover glass according to the invention which can be connected to the mirror reflector via a threading.

In the embodiment according to FIG. 4, outer threads 25 are provided on the beaded edge (preferably formed of mineral glass) 23 of the mirror reflector 24. The cover glass 26 consists of a glass plate 27 and an axially extending ring (preferably formed of mineral glass) 28, whose inside is provided with internal threads 29. In this embodiment, the cover glass 26 is screwed onto the mirror reflector 24 like a screw cap. The thread elements 25, 29 form a screw connection 30.

In the various embodiments, the glass plate 12 or 27 may optionally be smooth and colorless and transparent or be designed as an optical lens to achieve a defined angle of radiation, or additionally as a colored filter.

According to another aspect of the invention, plural glass elements may be provided to enable the user to change the color of illumination provided. The individual cover glass elements may be made with textured or other surfaces to provide different illumination conditioning such as by providing a lens for conditioning the illumination. As noted above, the use of lenses and the like may achieve a defined angle of radiation and illumination. Different coatings are also possible according to the invention to provide changes in color and other coatings are possible to provide additional types of illumination conditioning.

While specific embodiments of the invention have been shown and described in detail to illustrate the application of the principles of the invention, it will be understood that the invention may be embodied otherwise without departing from such principles.

What is claimed is:

1. A metal oxide vaporized mirror lamp, comprising: a metal oxide vaporized mirror reflector formed of coated mineral glass for reflecting cold light and allowing infrared radiation to pass through, including a projection and an opposite light passage opening; an electrical connection insert positioned in said projection a low-voltage lamp arranged detachably connected to said insert by two connection pins; a cover plate formed of mineral glass, said cover plate closing said light passage opening of said mirror reflector; a bayonet connection including a mirror reflector bayonet element, formed integral with said mirror reflector and a cover plate bayonet element formed integral with said cover element.

2. A metal oxide vaporized mirror lamp according to claim 1, wherein said mirror reflector bayonet element includes a beaded edge provided on said mirror reflector delimiting said light passage opening, said beaded edge including at least two recesses, said cover glass bayonet element including at least two essentially L-shaped projections having free ends which may be passed through said recesses in said beaded edge and extended behind said beaded edge after rotation of said cover glass relative to said mirror reflector.

3. A metal oxide vaporized mirror lamp, comprising: a metal oxide vaporized mirror reflector formed of coated mineral glass for reflecting cold light and allowing infrared radiation to pass through, said mirror reflector including a projection and an opposite light passage opening; an electrical connection insert positioned in said projection; a low voltage lamp arranged detachably connected to said insert by two connection pins; a cover plate formed of mineral glass, said cover plate closing said light passage opening of said mirror reflector; a screw connection including a mirror reflector screw connection element formed integral with said mirror reflector and a cover glass screw connection element formed integral with said cover plate.

4. A metal oxide vaporized mirror lamp according to claim 3, wherein said screw connection mirror reflector element includes outwardly directed thread elements provided on a bead edge delimiting the light passage opening of said mirror reflector and said screw connection cover plate inwardly directed thread elements provided on an axially extending ring of said cover glass.

5. A metal oxide vaporized mirror lamp according to claim 1, wherein a plurality of cover glass elements are provided, each with different optical and/or color properties, each being interchangeably connectable with said mirror reflector.

6. A metal oxide vaporized mirror lamp according to claim 3, wherein a plurality of cover glass elements are provided, each with different optical and/or color properties, each being interchangeably connectable with said mirror reflector.

7. A cold light mirror lamp comprising: a cold light mirror reflector including mineral glass coated to form a metal oxide vaporized mirror for reflecting cold light and allowing infrared radiation to pass through, said mirror reflector including a projection and an opposite light passage opening; an electrical connection insert positioned in said projection; a low voltage lamp positioned detachably connected to said insert by two connection pins; a cover plate formed of mineral glass, said cover plate closing said light passage opening of said mirror reflector; direct force locking connection means including a cover glass connection part formed integral with said cover glass and a mirror reflector connection part formed integral with said mirror reflector for direct force lockingly connecting said cover glass to said mirror reflector.

8. A cold light mirror lamp according to claim 7, wherein said direct force locking connection means comprises a bayonet connection arrangement, said mirror reflector connection part including a beaded edge provided on said mirror reflector delimiting said light passage opening, said beaded edge including at least two recesses, said cover glass connection part including at least two substantially L-shaped projections having free ends, said free ends being passed through said recess to said beaded edge and extending behind said beaded edge after rotation of said cover glass relative to said mirror reflector.

9. A cold light mirror lamp according to claim 7, wherein said direct force locking connection means comprises a screw connection, said mirror reflector connection part includes an outwardly directed thread element provided on a bead edge delimiting said light passage opening and said cover plate connection part including inwardly directed thread elements provided on an axially extending ring of said cover glass.

* * * * *